US006801169B1

(12) United States Patent
Chang et al.

(10) Patent No.: US 6,801,169 B1
(45) Date of Patent: Oct. 5, 2004

(54) MULTI-BAND PRINTED MONOPOLE ANTENNA

(75) Inventors: Kuang-Yuan Chang, Tu-chen (TW); Lung-Sheng Tai, Tu-Chen (TW); Hsien-Chu Lin, Tu-vchen (TW); Zhen-Da Hung, Tu-Chen (TW); Chia-Ming Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/423,631

(22) Filed: Apr. 24, 2003

(30) Foreign Application Priority Data

Mar. 14, 2003 (TW) ..... 92203993 U

(51) Int. Cl.[7] ..... H01Q 1/38

(52) U.S. Cl. ..... 343/700 MS; 343/830; 343/846

(58) Field of Search ..... 343/700 MS, 702, 343/825, 829, 830, 846, 848

(56) References Cited

U.S. PATENT DOCUMENTS

| | | | | |
|---|---|---|---|---|
| 5,828,340 A | * | 10/1998 | Johnson | 343/700 MS |
| 6,249,254 B1 | * | 6/2001 | Bateman et al. | 343/700 MS |
| 6,362,789 B1 | * | 3/2002 | Trumbull et al. | 343/700 MS |
| 6,670,923 B1 | * | 12/2003 | Kadambi et al. | 343/700 MS |

* cited by examiner

*Primary Examiner*—James Vannucci
*Assistant Examiner*—Shih-Chao Chen
(74) *Attorney, Agent, or Firm*—Wei Te Chung

(57) ABSTRACT

A multi-band printed monopole antenna (1) includes a substrate (2), a ground portion (4) disposed on the substrate, a radiating portion disposed beside the ground portion and feeder cable (5). The radiating portion comprises a first and second radiating patches, (31, 34) and a first and second connecting patches (32, 33). The second radiating patch resonances at a lower frequency band. A resonance slot formed between the first radiating patch and the ground portion for occurring a secondary resonance in a higher frequency band.

17 Claims, 9 Drawing Sheets

Scale: 5dBi/div
Operating Frequency: 2.5GHz
Horizontally polarized

Scale: 5dBi/div
Operating Frequency: 2.5GHz
Vertically polarized

Scale: 5dBi/div
Operating Frequency: 5.35GHz
Horizontally polarized

Scale: 5dBi/div
Operating Frequency: 5.35GHz
Vertically polarized

Scale: 5dBi/div
Operating Frequency: 5.598GHz
Horizontally polarized

Scale: 5dBi/div
Operating Frequency: 5.598GHz
Vertically polarized

MULTI-BAND PRINTED MONOPOLE ANTENNA

BACKGROUND OF THE INVENTION

1. Field of the Invention

The present invention relates to an antenna, and in particular to a multi-band printed monopole antenna employed in a mobile electronic device.

2. Description of the Prior Art

The development of wireless local area network (WLAN) technology has been attended by the development of devices operating under the IEEE 802.11b standard (in the 2.45 GHz band) and the IEEE 802.11a standard (in the 5.25 GHz band). These devices benefit from a multi-band antenna.

In order to minimize the size of an antenna and permit multi-band operation, multi-band monopole antennas have been developed for use with certain communication applications. More specially, U.S. Pat. No. 6,100,848 discloses a multi-band printed monopole antenna including a ground plane, a printed circuit board (PCB) 12, a conductive trace 18 and a parasitic element 20 respectively formed on the opposite sides of the PCB 12. The conductive trace 18 has an electrical length in which primary resonance occurs within a first frequency band. The parasitic element 20 is coupled to the conductive trace 18 but not directly connected to tune the conductive trace 18 to a secondary resonance within a second frequency band. However adding a parasitic element 20 will add manufacturing cost to the antenna. Furthermore, putting the parasitic element on the opposite side will also add complexity to manufacturing.

Hence, an improved multi-band antenna is desired to overcome the above-mentioned disadvantages of the prior art.

BRIEF SUMMARY OF THE INVENTION

A primary object, therefore, of the present invention is to provide a simple multi-band printed monopole antenna for operating in different frequency bands.

A multi-band printed monopole antenna in accordance with the present invention for an electronic device includes a substrate, a radiating element formed on a surface of the substrate comprising a first and second radiating patches and a first and second connecting patches, a ground portion beside the radiating element and a feeder cable. The radiating element is in a rectangular window shape with a gap in one side. The ground portion comprises a long conductive patch parallel to the first radiating patch and a short conductive patch. The long conductive patch is near to the first radiating patch. The coupling between the first radiating patch and the long conductive patch occurs a first resonance within a first frequency band. The second radiating patch occurs a second resonance in a second frequency band.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
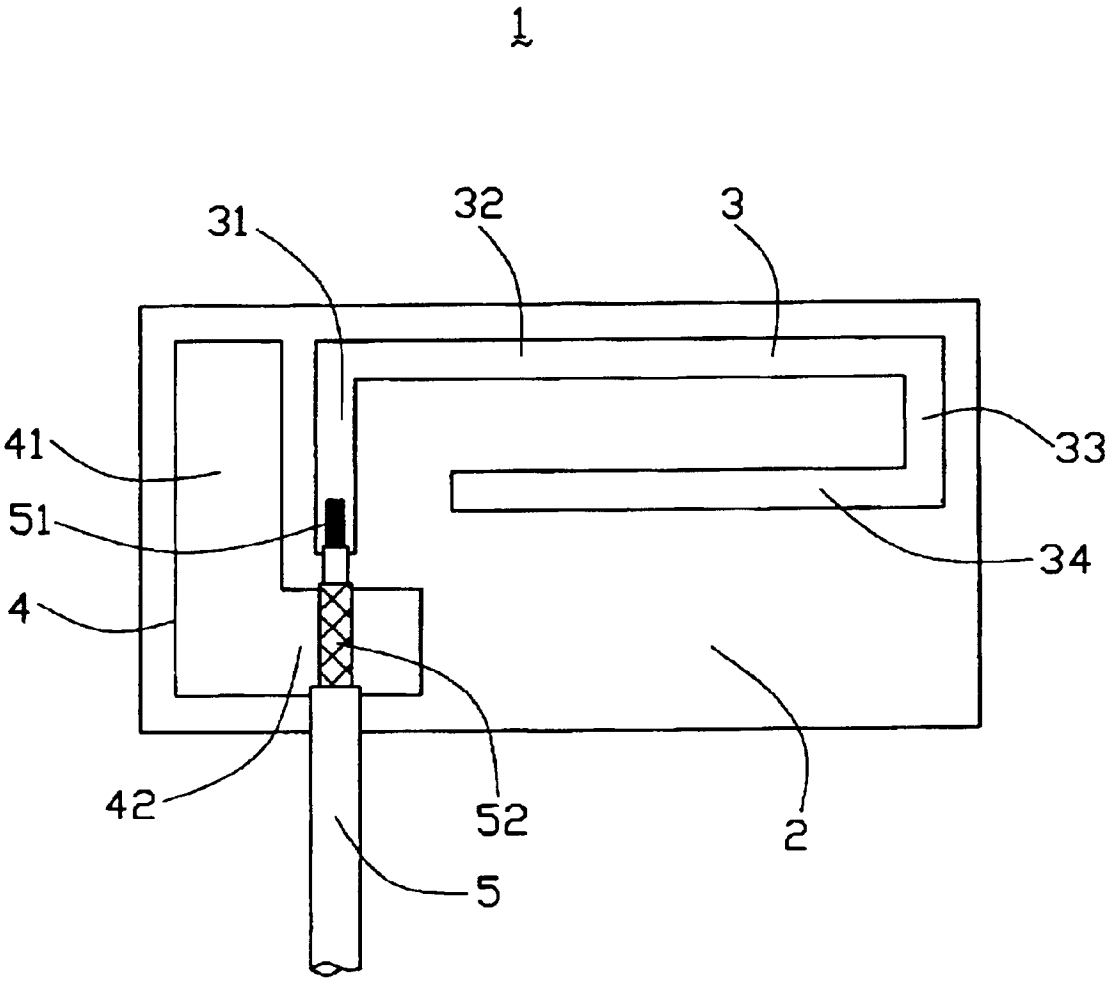
FIG. 1 is a plan view of a preferred embodiment of a multi-band printed monopole antenna in accordance with the present invention, with a coaxial cable electrically connected thereto.

Referring to FIG. 1, a multi-band printed monopole antenna 1 in accordance with a preferred embodiment of the present invention comprises an dielectric substrate 2, a radiating element 3, a ground portion 4 and a feeder cable 5.

The substrate 2 is a substantially rectangular board having a upper surface. The ground portion 4 is formed of a metal plate and has a L-shape configuration. The ground portion 4 is disposed on a corner of the upper surface the substrate 2 and comprises a long conductive patch 41 and a short conductive patch 42 respectively parallelly extending along a first short side and a long side of the substrate 2. The length of the long conductive patch 41 is a little shorter than that of the first short side of the substrate 2 and the length of the short conductive patch 42 is one third of that of the long side of the substrate 2.

The radiating portion 3 is formed of metical material and has a rectangular window shape. The radiating portion comprises a first and second radiating patches 31, 34 and a first and second connecting patches 32, 33. The first radiating patch 31 is parallel to the long conductive patch 41 and with a first end adjacent to the short conductive patch 42 and a second end adjoined with an end of the long conductive patch 41. Thus an elongate slot is formed between the long conductive patch 41 and the first radiating patch 31. The first connecting patch 32 extends perpendicularly from the second end of the first radiating patch 31 along the long side of the substrate 2. The first connecting patch 32 and the second connecting patch 33 are perpendicular to each other and connect on a common end. The second connecting patch 33 extends along a second short side of the substrate 2 and ends on a middle portion of the second short side of the substrate 2. The second radiating patch 34 perpendicularly extends from another end of the second connecting patch 33 with a free end near to the first radiating branch 31.

The feeder cable 5 is a coaxial cable and comprises a conductive inner core 51, a dielectric layer (not labeled), a conductive outer shield 52 over the dielectric layer, and an outer jacket (not labeled). The inner core 51 is soldered on the first end of the first radiating patch 31 and the outer shield 41 is soldered onto the short conductive patch 42.

Figure 2:
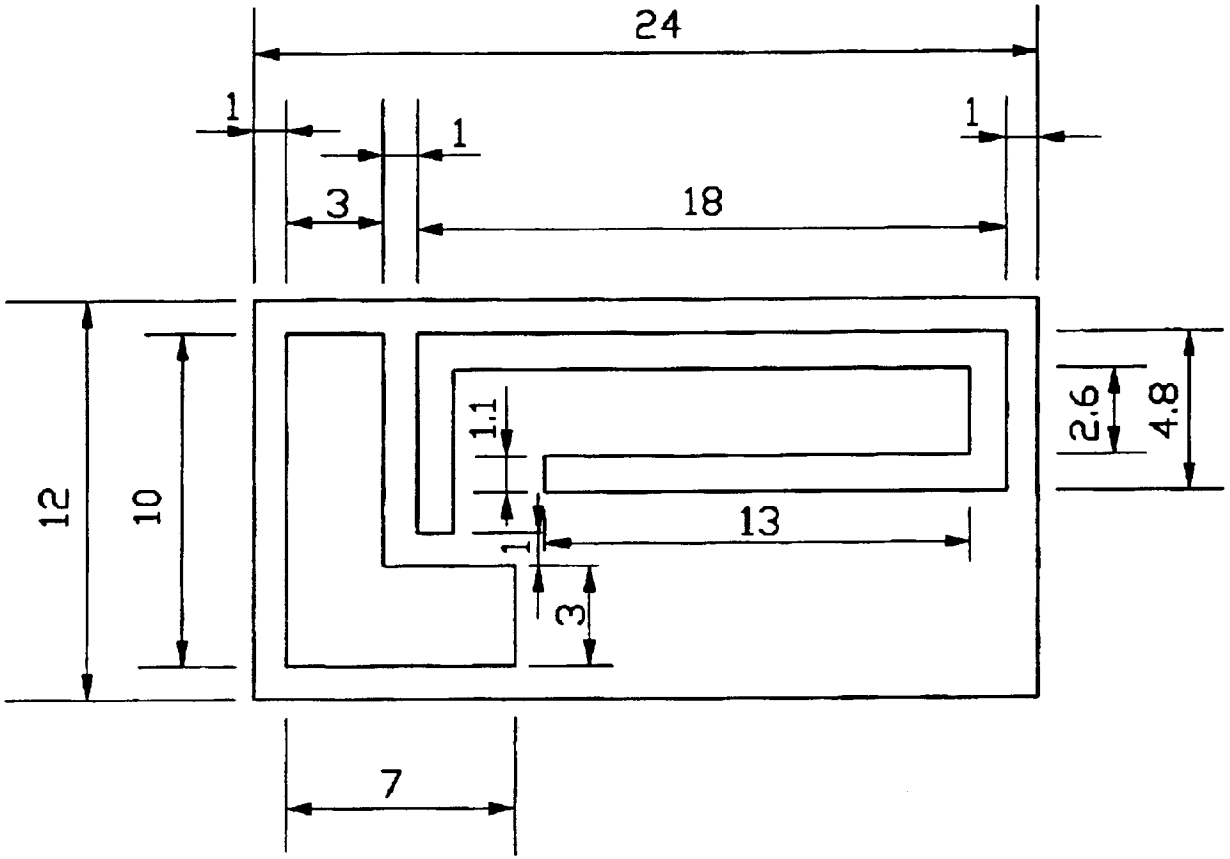
FIG. 2 is a plan view of the multi-band printed monopole antenna of FIG. 1, showing detailed dimensions of the multi-band printed monopole antenna.

Referring to FIG. 2, major dimensions of the multi-band printed monopole antenna 1 are labeled thereon, wherein all dimensions are in millimeters (mm).

The multi-band printed monopole antenna 1 occurs a first resonance in a lower frequency band by the second radiating patch 34. Additionally, in this case, the multi-band printed antenna 1 benefits from the winding of radiation portion 3 to improve its impedance matching. The coupling between the first radiating patch 31 and the long conductive patch 41 causes the multi-band printed antenna 1 to occur a second resonance in a higher frequency band and achieve wide band operation.

In assembly, the multi-band antenna 1 is assembled in an electronic device (e.g. a laptop computer, not shown) by the substrate 2. The ground portion 4 is grounded. RF signals are fed to the multi-band printed monopole antenna 1 by the conductive inner core 51 of the feeder cable 40 and the conductive outer shield 52.

Figure 3:
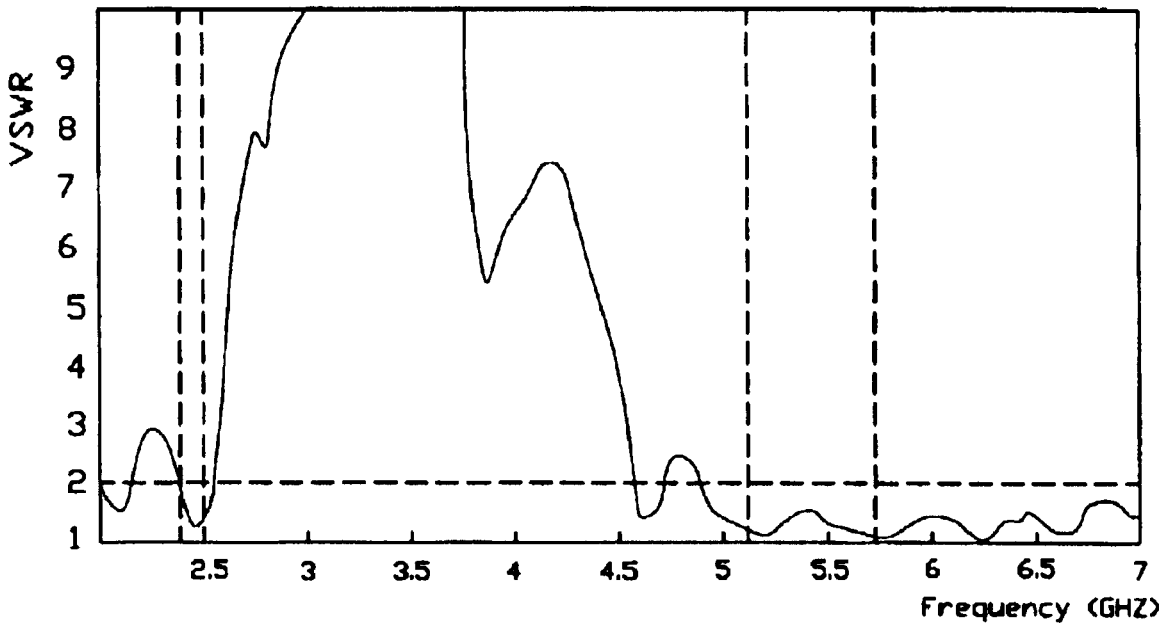
FIG. 3 is a test chart recording for the multi-band printed monopole antenna of FIG. 1, showing Voltage Standing Wave Ratio (VSWR) as a function of frequency.
Figure 4:
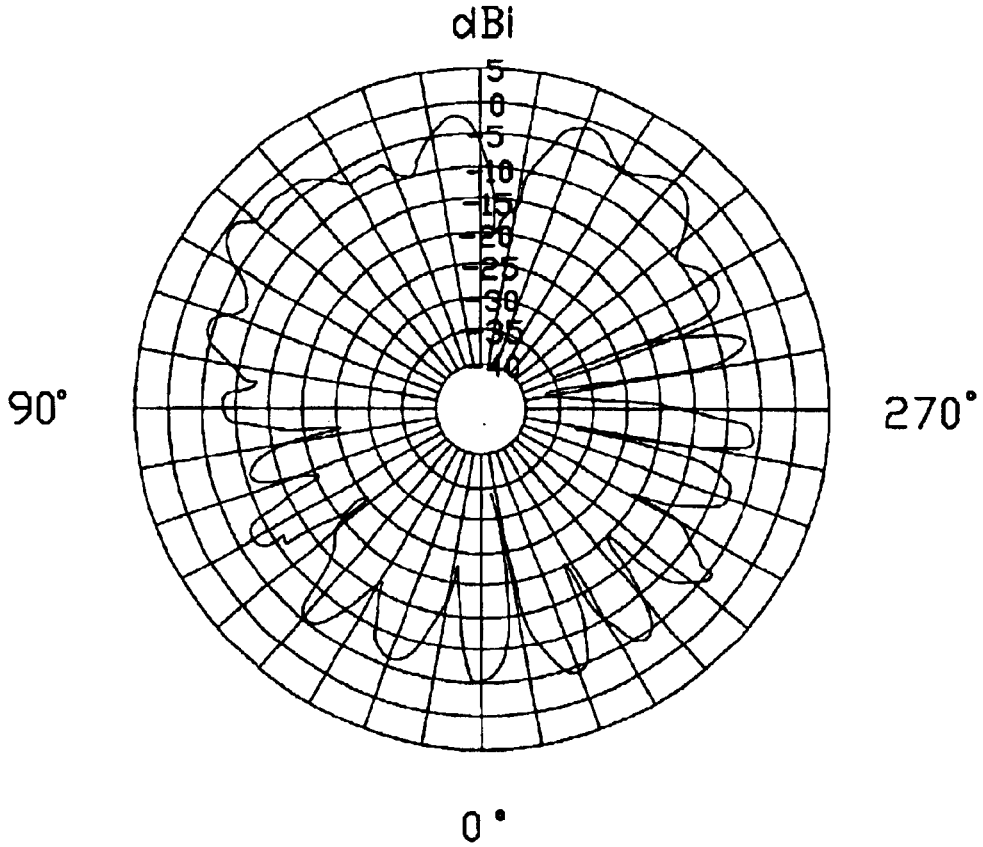
FIG. 4 is a horizontally polarized principle plane radiation pattern of the multi-band printed monopole antenna of FIG. 1 operating at a frequency of 2.5 GHz.
Figure 5:
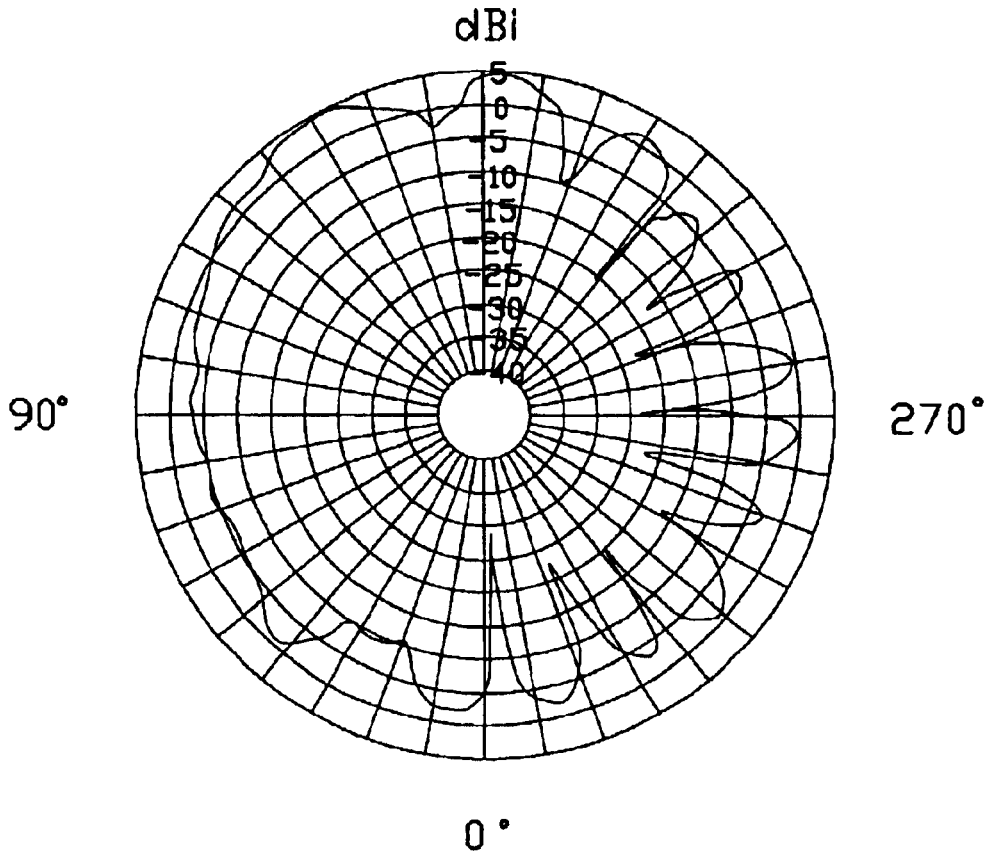
FIG. 5 is a vertically polarized principle plane radiation pattern of the multi-band printed monopole antenna of FIG. 1 operating at a frequency of 2.5 GHz.
Figure 6:
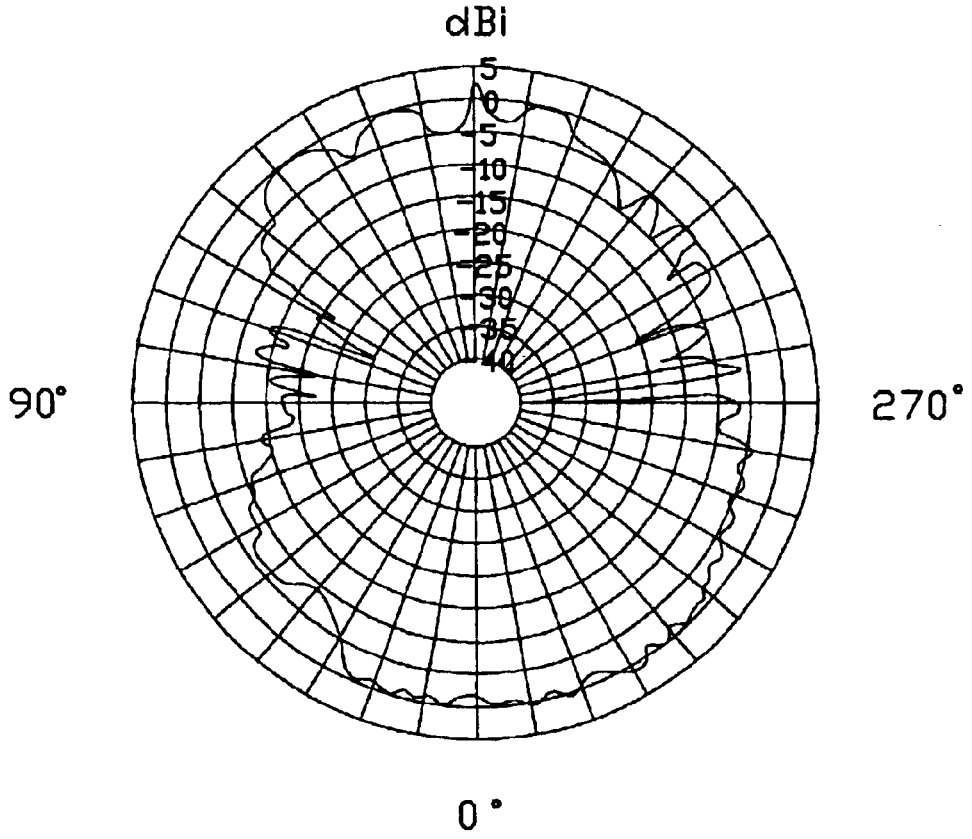
FIG. 6 is a horizontally polarized principle plane radiation pattern of the multi-band printed monopole antenna of FIG. 1 operating at a frequency of 5.35 GHz.
Figure 7:
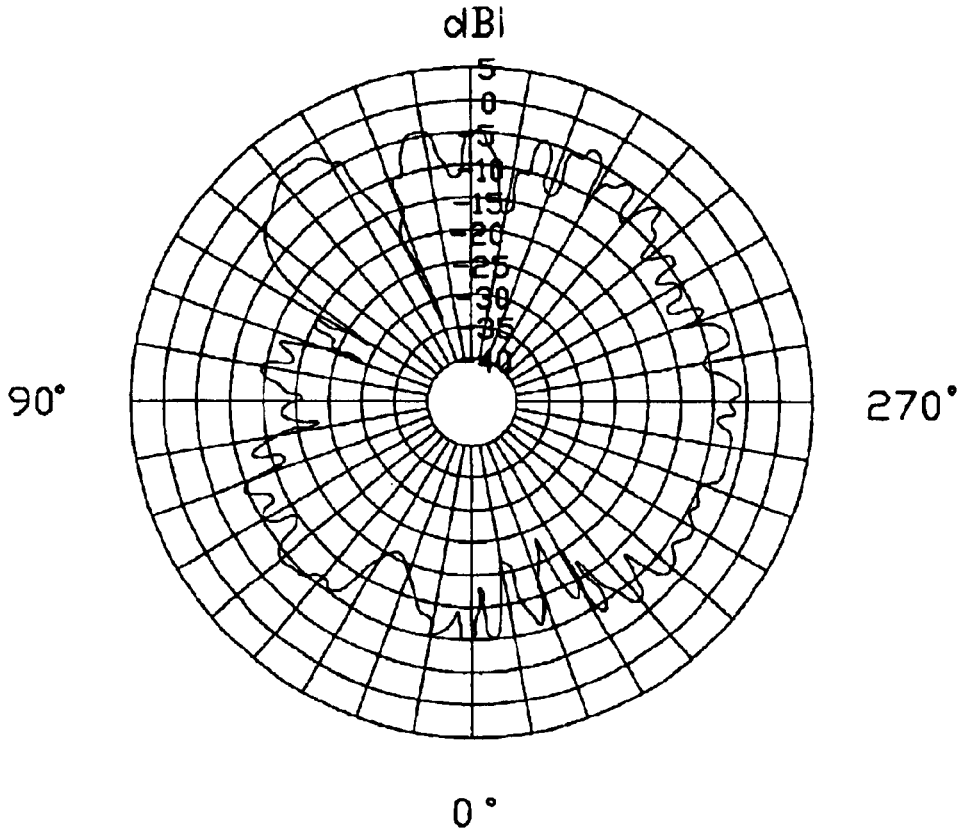
FIG. 7 is a vertically polarized principle plane radiation pattern of the multi-band printed monopole antenna of FIG. 1 operating at a frequency of 5.35 GHz.
Figure 8:
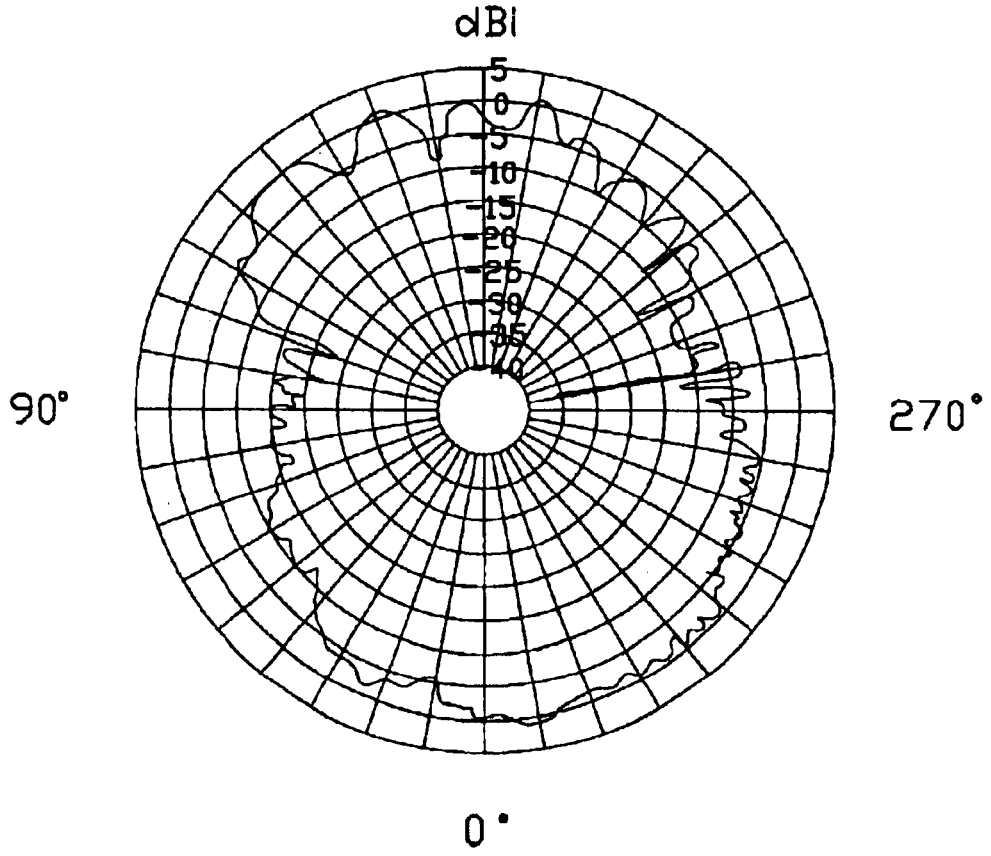
FIG. 8 is a horizontally polarized principle plane radiation pattern of the multi-band printed monopole antenna of FIG. 1 operating at a frequency of 5.598 GHz.
Figure 9:
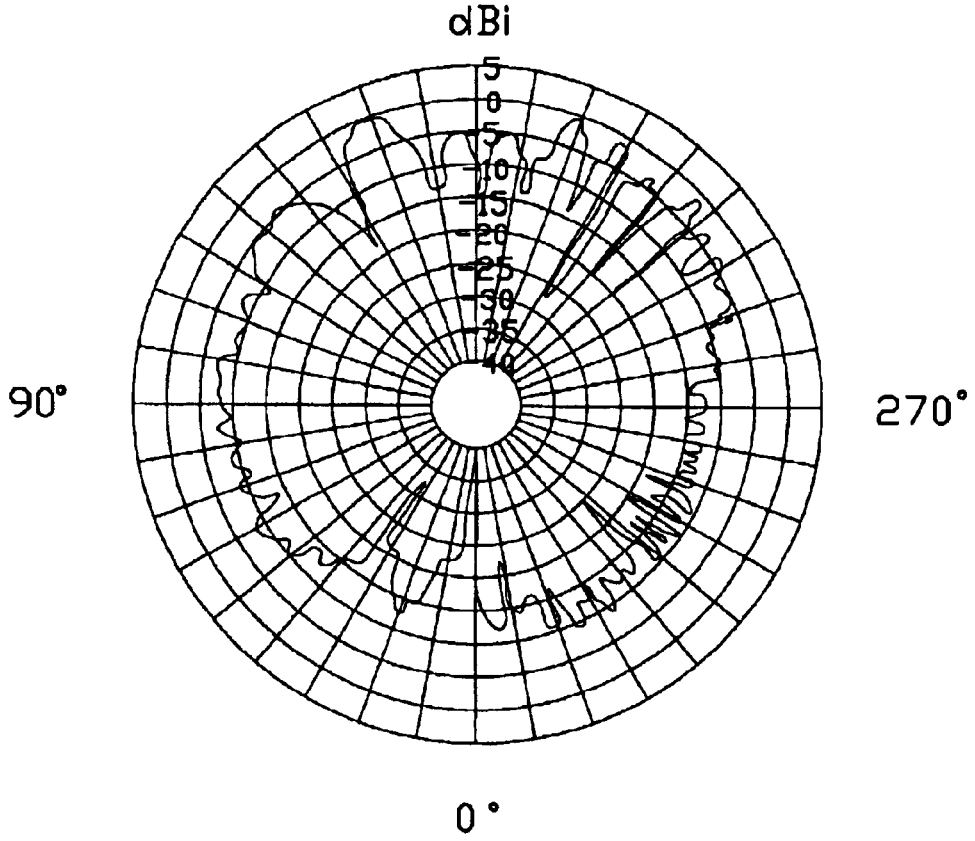
FIG. 9 is a vertically polarized principle plane radiation pattern of the multi-band printed monopole antenna of FIG. 1 operating at a frequency of 5.598 GHz.

FIG. 3 shows a test chart recording of Voltage Standing Wave Ratio (VSWR) of the multi-band printed monopole antenna 1 as a function of frequency. Note that VSWR drops below the desirable maximum value "2" in the 2.4–2.5 GHz frequency band and in the 5.15–5.725 GHz frequency band, indicating acceptably efficient operation in these two wide frequency bands, which cover the total bandwidth of the 802.11a and 802.11b standards.

FIGS. 4–9 respectively show horizontally and vertically polarized principle plane radiation patterns of the multi-band printed monopole antenna 1 operating at frequencies of 2.5 GHz, 5.35 GHz, and 5.598 GHz. Note that each radiation pattern is close to a corresponding optimal radiation pattern and there is no obvious radiating blind area.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna for an electronic device comprising:

a substrate;

a ground portion disposed on the substrate;

a radiating portion disposed beside the ground portion; and a feeder cable comprising a conductive inner core connecting with the radiating portion and a conductive outer shield connecting with the ground portion;

wherein the radiating portion electromagnetically couples with the ground portion to cause a first resonance in a first frequency band and causes a second resonance in a second frequency band.

2. The multi-band antenna as claimed in claim 1, wherein the radiating portion comprises a first radiating patch coupling with the ground portion and a second radiating patch causing the second resonance in the second frequency band.

3. The multi-band antenna as claimed in claim 2, wherein the ground portion comprises a long conductive patch that is parallel to the first radiating patch and a short conductive patch extending from the long conductive patch.

4. The multi-band antenna as claimed in claim 3, wherein the radiating portion further comprises a first and a second connecting portions formed in an "L" shape for interconnecting the first radiating patch with the second radiating patch.

5. The multi-band antenna as claimed in claim 4, wherein the feeder cable is a coaxial cable feeder and comprises a conductive inner core wire and a conductive outer shield.

6. The multi-band antenna as claimed in claim 5, wherein the inner core wire is electrically connected to the first radiating patch, and the outer shield is electrically connected to the ground portion.

7. A multi-band antenna for an electronic device operated in a first and second frequency bands comprising:

a substrate;

a ground portion disposed on the substrate;

a radiating portion disposed beside the ground portion;

a feeder cable comprising a conductive inner core connecting with the radiating portion and a conductive outer shield connecting with the ground portion; and a resonance slot formed between the ground portion and the radiating portion.

8. The multi-band antenna as claimed in claim 7, wherein the radiating portion comprises a first and second radiating portions.

9. The multi-band antenna as claimed in claim 8, wherein the ground portion comprises a long conductive patch and a short conductive patch.

10. The multi-band antenna as claimed in claim 9, wherein the resonance slot is defined between the first radiating portion and the long conductive patch.

11. The multi-band antenna as claimed in claim 10, wherein the feeder cable is a coaxial cable feeder and comprises a conductive inner core wire and a conductive outer shield.

12. The multi-band antenna as claimed in claim 11, wherein the inner core wire is electrically connected to the first radiating portion, and the outer shield is electrically connected to the ground portion.

13. A multi-band antenna comprising:

a printed circuit board defining opposite first and second surfaces thereon, and thereof a short dimension along a vertical direction and a long dimension along a horizontal direction perpendicular to said vertical direction;

an L-shaped grounding portion disposed on the first surface and defining a long conductive patch along said vertical direction and a short conductive patch along said horizontal direction and perpendicular to said long conductive patch; and a radiating portion disposed on said first surface and spatially beside said grounding portion, said radiating portion defining an elongated first radiating patch, for high frequencies, extending parallel to said long conductive patch and located in a rectangular area defined by said L-shaped grounding portion, and a second radiating patch, for low frequencies, extending parallel to said short conductive patch; wherein said second radiating patch extends with most of said long dimension along said horizontal direction.

14. The antenna as claimed in claim 13, wherein a corner defined by said L-shaped grounding portion is located adjacent to one coner of said printed circuit board.

15. The antenna as claimed in claim 13, wherein said second radiating patch does not invade said area defined by said L-shaped grounding portion.

16. The antenna as claimed in claim 13, wherein said first radiating patch and said second radiating patch is connected via a first connection patch extending along an edge of the printed circuit board in said horizontal direction and a second connection patch extending along another edge of the printed circuit board in said vertical direction.

17. The antenna as claimed in claim 13, wherein said radiating portion is formed by two different sized and mutually reversely linked L-shaped configurations.

* * * * *